United States Patent [19]

Yoshida

[11] 4,073,101

[45] Feb. 14, 1978

[54] UNIT AND COMBINED HOUSING STRUCTURES

[76] Inventor: Noboru Yoshida, No. 2-18, Shinonome-cho, Yamatotakada, Nara, Japan

[21] Appl. No.: 697,830

[22] Filed: June 21, 1976

Related U.S. Application Data

[63] Continuation of Ser. No. 529,011, Dec. 2, 1974, abandoned.

[30] Foreign Application Priority Data

Dec. 24, 1973 Japan ..... 48-2092

[51] Int. Cl.[2] ..... E04B 1/32

[52] U.S. Cl. ..... 52/79.1; 52/245

[58] Field of Search ..... 52/79.1, 245, 399, 36, 52/234, 236, 236.1, 244, 79.4, 80, 81, DIG. 10; 61/69; 220/1 B, 5 R, 4 C, 4 D, 9 E, 22, 84

[56] References Cited

U.S. PATENT DOCUMENTS

| | | | |
|---|---|---|---|
| 2,121,670 | 6/1938 | Saives | 52/245 |
| 2,173,076 | 9/1939 | Stetson | 52/36 |
| 2,310,765 | 2/1943 | Dornier | 52/245 |
| 2,575,454 | 11/1951 | Kuhler | 52/399 |

*Primary Examiner*—J. Karl Bell

*Attorney, Agent, or Firm*—McGlew and Tuttle

[57] ABSTRACT

Several rings, having a predetermined diameter and spaced axially at predetermined intervals are joined by horizontal reinforcing bars to constitute a framework, and then a wall is provided surrounding this framework to form a substantially cylindrical structure. A floor is laid at the bottom of this structure and the openings at both ends of the structure are closed with a wall material. A gateway door is provided at one or both of the ends of the structure. Suitable interior fittings are also provided in the structure.

7 Claims, 20 Drawing Figures

UNIT AND COMBINED HOUSING STRUCTURES

This is a continuation, of application Ser. No. 529,011 filed Dec. 2, 1974, now abandoned.

BACKGROUND OF THE INVENTION

This invention relates to a unit structure and a combination of the joined unit structures which can be effectively used for making a simple frame house, villa, cottage and the like in, for instance, vacation or leisure areas.

With the growing leisure boom in recent years, a strong demand is voiced for structures which passes mobility and other features for quick and easy assemblage and transport for use in leisure areas etc. So far, however, there has been proposed no structure or its kind which meets all of these requirements. Japanese Utility Model Publication No. 19284/1972, which is the only prior art contrivance related to the present invention, proposes a structure that is formed from a hexagonal shell. This structure, however, is complicated in setup and also troublesome in manufacture. Further, since this hexagonal-sectioned structure is built up by joining several separate frameworks, it is defective in strength and involves danger when such structures are used in layers.

SUMMARY OF THE INVENTION

The first object of the present invention is to provide a cylindrical unit structure which is simple in construction and has high suitability for mass production and transport as the basic framework of the structure is constituted only from rings and reinforcing bars.

The second object is to provide a unit structure of the type just described, which is capable of simplifying the base and installation works to allow reduction of the erection time and cost.

The third object is to provide unit structures of the this type which can be laid one on another with ease and can be communicated with each other to allow a saving in floor space for such structures.

It is also an object of the present invention to provide a unit structure of the described type which is simplified in construction while maintaining high strength for accomplishing the third object above.

The other features and advantages of the present invention will become apparent from the following detailed description of the preferred embodiments of the invention.

DESCRIPTION OF THE PREFERRED EMBODIMENTS

The present invention will now be described in detail by way of some preferred embodiments thereof while having reference to the accompanying drawings.

Figure 1:
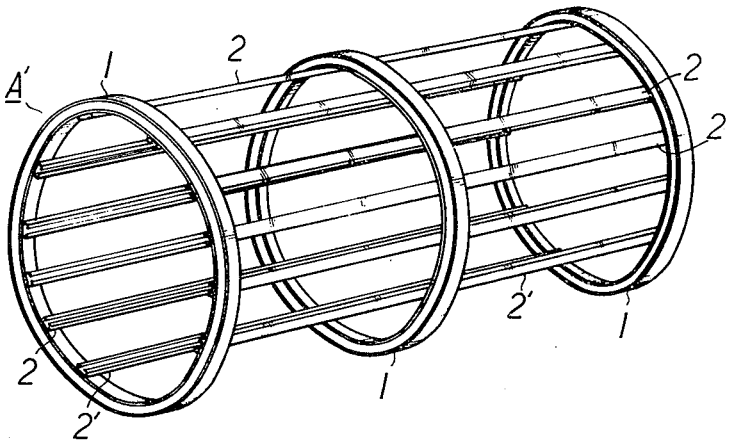
FIG. 1 is a perspective view of the framework of a unit structure according to the present invention.
Figure 2A:
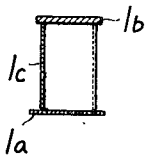
FIG. 2A is an enlarged radial sectional view of a ring used in the structure of the present invention.
Figure 2B:
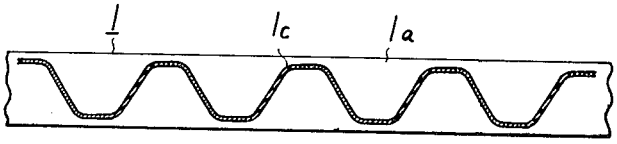
FIG. 2B is an enlarged peripheral sectional view of the principal part of the ring shown in FIG. 2.

Referring first to FIG. 1, it will be seen that several rings 1 . . . are arranged axially at fixed intervals and these rings are connected by a plurality of horizontal reinforcing bars 2, 2′ . . . to constitute a framework A′. The rings 1 . . . are made of steel, cast steel, aluminium alloy or other suitable material and so formed as to have, for example, an I-shaped section. The rings may also be made by welding a corrugated reinforcing plate 1*c* between an inboard plate 1*a* and an outboard plate 1*b* as shown in FIGS. 2A and 2B. Use of the rings formed as in FIGS. 2A and 2B provides a greater reinforcing effect than when using the I-beam section rings. The reinforcing bars 2, 2′ . . . are usually made of C-shaped steel and are secured axially of and spanning the rings 1 at their bottom portions, right and left side portions and the portions corresponding to the contact points produced when stacking the structures in layers as described later, as well as at the interior parts intermediate these portions. They are secured to the inner peripheries of the rings by means of a predetermined number of bolts 3. It is desirable to use large-diameter bars for the reinforcing bars 2′ which are positioned on both sides of the bottom bar as such side bars are designed to concurrently serve as floor plate supports. For the remaining reinforcing bars 2, it is preferred to use bars which are substantially the same in thickness as the wall plate.

The flooring, walls and interior fittings are then applied to the framework A′ in the following way.

Figure 8:
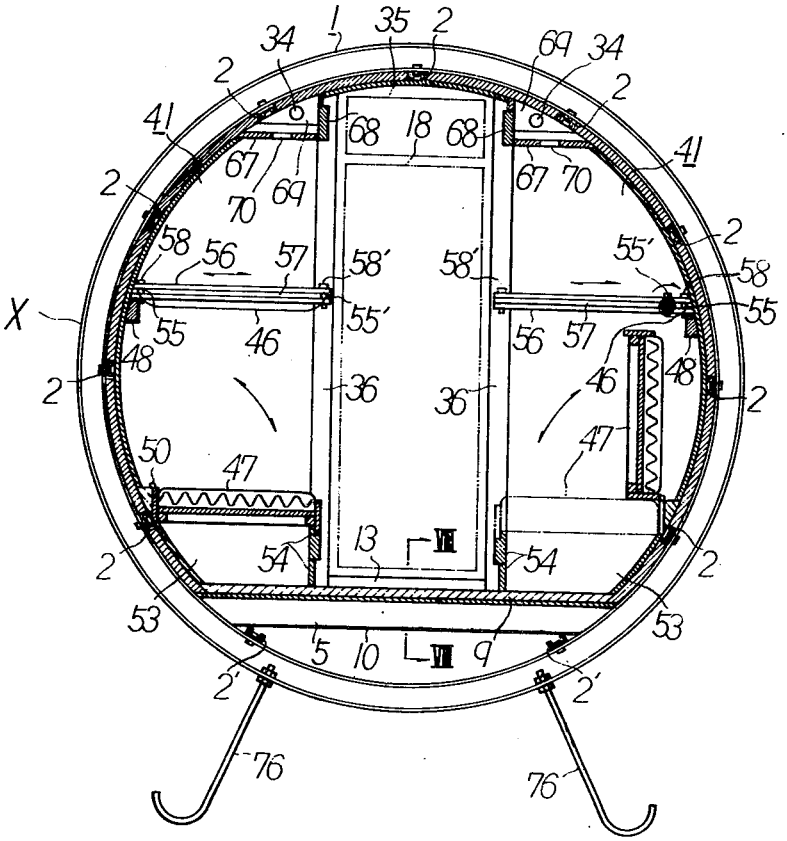
FIG. 8 is a sectional view taken along the line VII—VII of FIG. 6.
Figure 9:
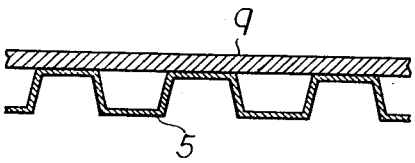
FIG. 9 is an enlarged sectional view taken along the line VIII—VIII of FIG. 8.

First, a bottom plate 5 is placed between the bottom reinforcing bars 2′, 2′ and then the peripheral wall 6 is applied spanning the interior sides of the rings 1 excluding the bottom portions thereof, thereby to form the cylindrical body of a structure as shown in FIG. 8. Then, in the inside of the thus formed structure, a floor plate 9 is placed on bottom plate 5. The floor plate 9 may be laid on the upper side of the bottom plate after forming the peripheral wall 6 over the entire interior faces of the rings 1, but, in this embodiment, a corrugated floor plate 5, called a deck plate, such as shown in FIG. 9, is placed horizontally at the bottom portion of the structure and then the peripheral wall 6 is built over the remaining inner peripheral faces, thereby forming a horizontal ground-engaging face 10 at the underside of the bottom portion of the structure to ensure stability at the time of installation. It is to be also noted that the bottom plate 5 and the floor plate 9 are combined in lamination to increase the strength of the bottom portion of the structure. Although not shown in the drawings, an intermediate member may be disposed between bottom plate 5 and floor plate 9 so as to form a space therebetween to accommodate ventilation and/or piping arrangements in the bottom portion of the structure.

Figure 10:
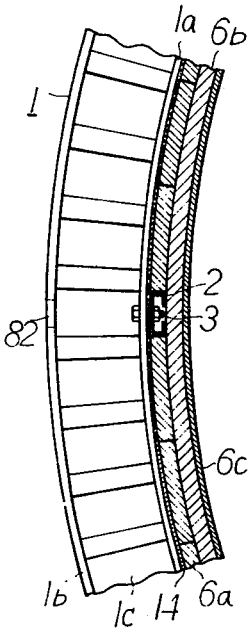
FIG. 10 is an enlarged sectional view of the portion X of FIG. 8, showing an example of construction of the peripheral wall.

The peripheral wall 6 may be built up in a manner as for instance shown in FIG. 10. That is, a plurality of wall plates 6*a*, each having a predetermined width, are arranged side by side in succession between the respective reinforcing bars 2, 2' so as to span the interior faces of the rings 1. Although such wall plates may be bonded by an adhesive, they can be also easily nailed to the inner surfaces of the rings 1 by a compressor, in which case the inboard plates 1*a* of the rings are formed slightly smaller in thickness. Rubber sheets 14 or the like are disposed between the interior faces of the rings 1 and the respective reinforcing bars 2, 2' and wall plates 6*a* for prevention of rust. Also, the external surfaces of the wall plates 6*a* are sheathed with a refractory wall 6*b*, such as a metal plate, and a water-proof wall 6*c*. On the inside of the wall plates 6*a* are provided a heat-insulating wall material 6*d*, such as foamed styrol, and a decorative sheet or smoothly planed board 6*e*. Thus, the peripheral wall 6 of the structure is of a multifold construction to improve waterproofness and heat insulation.

Figure 3:
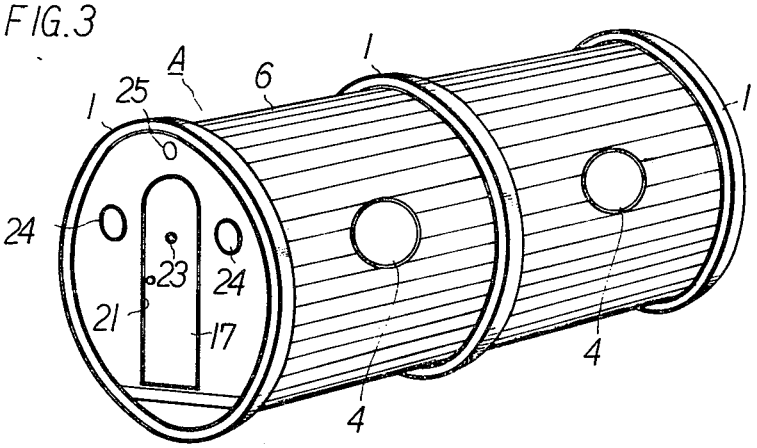
FIG. 3 is an external perspective view of a completed unit structure according to the present invention.
Figure 4:
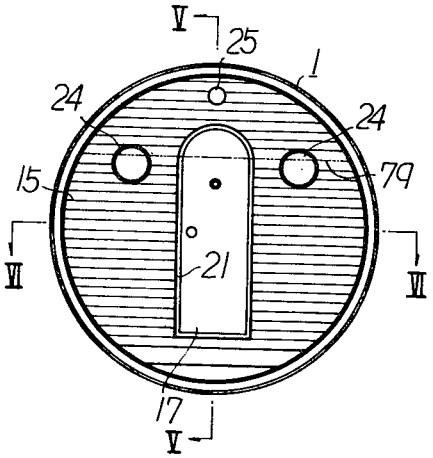
FIG. 4 is a front view thereof.
Figure 5:
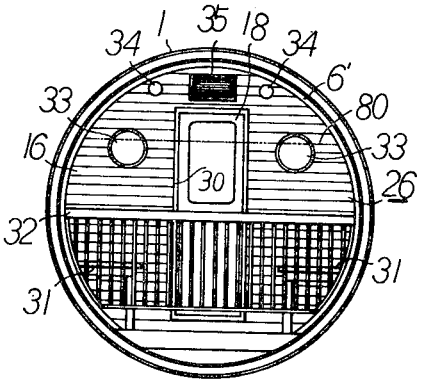
FIG. 5 is a backside view thereof.
Figure 6:
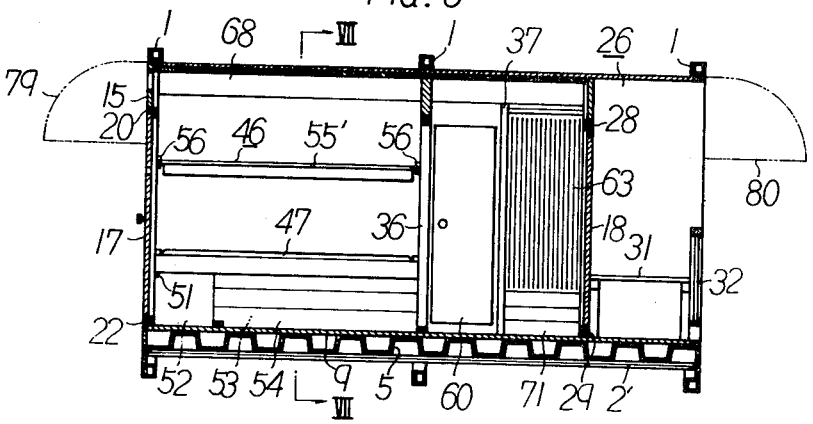
FIG. 6 is a sectional view taken along the line V—V of FIG. 4.
Figure 7:
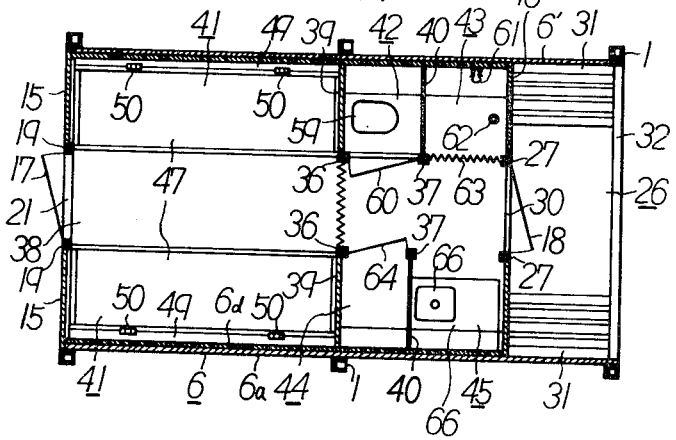
FIG. 7 is a sectional view taken along the line VI—VI of FIG. 7.

Then, the front and rear end openings of the cylindrically constructed structure as shown in FIG. 3 are closed with the front end wall 15 and the rear end wall 16, respectively, of the same wall material 6 as said before, and the entrance-exit doors 17 and 18 are provided in both end walls. More concretely, as shown in FIGS. 4 to 7, a pair of pillars 19, 19 are erected at suitable positions in the front end opening such as to define therebetween an entrance-exit space, and then a horizontal beam 20 is spanned across the top ends of both pillars 19, 19 to form a doorway 21, and a door 17 is provided in this doorway 21, with the other part of the front end opening being closed with the wall 15. Numeral 22 indicates a bottom girder for the door 17. It is provided on the floor plate 9 and designed to serve both for reinforcement of the doorway 21 and for prevention of removal of the entrance mat (not shown). 23 is a judas window provided in the door 17, 24, 24 round windows provided openably in the front end wall 15, and 25 a gate lamp. In this embodiment of the invention, a veranda 26 is provided on the rear side of the structure. Therefore, pillars 27, 27 are erected at suitable positions inwardly of the rear end of the structure and a horizontal beam 28 and a bottom girder 29 are provided between these pillars in the same way as in the front entrance to form a back entrance 30 between the interior of the structure and the veranda 26. Also, a door 18 is provided in this entrance, with the other part of the rear end of the structure being closed with the wall 16. The surface of the rear end wall 16 need not necessarily be covered with a metal plate 6*b* and a waterproof wall material 6*c* such as applied on the peripheral wall 6; it suffices to apply merely a decorative sheet. It is however desirable to provide a heat insulating wall material 6*d* and an interior decorative sheet 6*e*, such as above-mentioned, on the interior of the rear end wall 16. The peripheral wall 6' of the veranda 26 is formed by a part of the peripheral wall 6 of the structure, and its inside need not necessarily be provided with a heat insulating wall material 6*d*; it suffices to face it with a decorative sheet as in the case of the rear end wall 16. The decorative sheet or board used for facing the surface of the rear end wall 16 and that for the interior surface of the peripheral wall 6' of the veranda 26 need not necessarily be the same but may be suitably selected from various types. Fixed seats 31, 31 may be provided, for instance, on both sides of the veranda 26, and a handrail 32 of a suitable height is provided at the rear end opening of the structure. Numerals 33, 33 denote round windows provided openably in the rear end wall 16, 34, 34 ventilating holes, and 35 a louver for air conditioning. A suitable air cooling and/or heating apparatus may be installed in this part as a built-in.

Now, the internal fittings and makeup of the structure will be described.

In the inside of the structure and intermediate front pillars 19, 19 and rear pillars 27, 27, there are erected central pillars 36, 36 and auxiliary pillars 37, 37 so as to form a pathway 38 that extends centrally through the interior of the structure. Between pillars 36, 36 and 37, 37 and the peripheral wall 6 are provided the partition walls 39, 39 and 40, 40 so as to form the bedrooms 41, 41 on both sides of the pathway 38 and on the front entrance side of the central pillars 36, 36, while forming a lavatory and a shower room or such in the veranda side section and leftwise of the pathway 38 and a locker 44 and a cookery 45 or kitchen on the right side. In each of the bedrooms 41, 41 is provided a double bunk 46, 47 (forming four beds in all). In this case, bed mounting frames 48, 49 adapted to concurrently serve as structure reinforcement are provided horizontally at two upper and lower portions on the interior side of the peripheral wall 6 corresponding to the bedrooms 41, 41, and lower beds 47, 47 are mounted on the lower mounting frames 49, 49 by means of a predetermined number of hinges 50 such that the lower beds may be raised up to the vertical position when not in use. Both longitudinal edges of each lower bed 47 are supported by a supporting frame 51 mounted horizontally spanning the inside of the front end wall 15 and the inside of the corresponding partition wall 39 so that the lower bed is normally maintained in its horizontal position. Beneath each bed 47 are formed a footwear container 52 and a bedding and valuables container 53. Between containers 52 and 53 is provided a partition wall (not shown) such that each footwear container 52 may be opened from its pathway side while each pathway side portion of the article container 53 is closed by a closure plate 54. The top of the container 53 is open so that it may be covered by the bed 47. That is, the bed 47 serves as a cover for the article container 53. Thus, valuables are kept in the container 53 closed by the bed so that they are burglar-proof when one sleeps on the bed, and when one rises up from the bed, he may raise up the bed and put his bedding into the container 53 for easy fixing-up. In this way, the space below each bed 47 can be utilized to the best advantage.

The upper bed 46 is usually formed by spreading a flexible sheet such as canvas between a pair of rods 55, 55' and constructed such that it may be rolled up or folded down. Numeral 56 indicates the supporting frame members each of which has a C-shaped guide channel 57 along the length of the frame member. They are disposed in pairs in opposed relation between pillars 19, 19 and 36, 36 and the bed mounting frames 48, 48, and both ends of the rods 55, 55' of each upper bed 46 are fitted and supported in each channel so that the bed 46 can be rolled up if so desired. To put it more concretely, each rod 55 on the peripheral wall side is fixed by a pin 58 while the rods 55' on the pathway side are supported rollable back and forth along the respective guide channels 57, and pin holes (not shown) are provided at the front ends of the guide channels 57 for detachably engaging and fixing both ends of each said rod 55'. Thus, when one wants to use the upper bed 46 for sleeping, he may fix both ends of each rod 55' at the front ends of the supporting frame members 56 by pins 58' to secure the spread-out position of the bed. When the bed is not used, each rod 55' is rolled toward the peripheral wall while winding the bed 46 therearound, thus allowing maximum utilization of the space above the lower beds 47 as well as use of the lower beds as sofas.

A toilet stool (or bowl) 59 is provided in the lavatory 42 and a door 60 is hinged at its entrance. A shower spout 61 is provided at a suitable place in the shower room 43 and a draining hole 62 in the floor of this room, while a waterproof accordion curtain 63 is provided at its entrance. The inner wall and floor of the shower room 43 are faced with tile-like metal sheets to provide waterproofness. The locker 44 is also provided with a door 64 at its entrance and hanger holders (not shown) or such in the inside. In the cockery 45 are provided a dresser 65, a washstand 66, a hot-water heater (not shown) and the like. All of the rooms 41, 42, 43, 44 and 45 on both sides of the central pathway 38 are ceiled enclosed at their upper portions by ceiling boards 67, 67 and skirting boards 68, 68 so as to form ventilation air passages 69, 69 in the ceiling. There are also provided ventilating holes 70 at suitable locations in the ceiling boards 67, 67 so that the rooms are always ventilated through the ventilating holes 70, air passages 69, 69 in the ceiling and ventilating holes 34, 34 at the veranda side end of the structure. At the skirt of the entrance of the shower room 43 is provided a drain board 71 adapted to prevent scattering of water to the outside of the room 43 when a shower is taken.

In the foregoing discussion of the invention, a representative embodiment of the unit type structure A has been described, but the present invention is not limited to such embodiment but may be embodied in other ways such as mentioned below.

Figure 11:
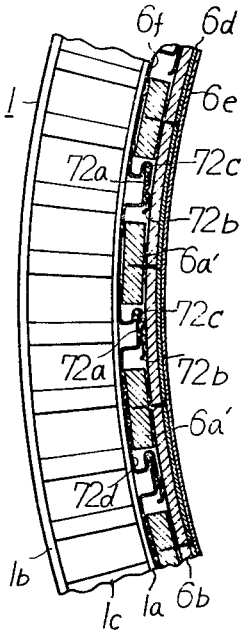
FIG. 11 is a same view of the same port on as FIG. 10 but showing another example of construction of the peripheral wall.

As regards, for instance, the construction of the peripheral wall 6, such peripheral wall has been formed, in the foregoing embodiment, by using a wooden wall plate **6*a* as a base and applying on both the inside and outside thereof, a foamed resin-made heat-insulating wall material 6*d*, interior decorative sheet 6*e*, metal-made refractory wall material 6*b* and exterior waterproof wall material 6*c*, but it is also possible to use an exterior wall material 6*f* called spandrel, as shown in FIG. 11. This wall material 6*f* is made by bending a metal sheet such as a steel or aluminium sheet which has been coated with a paint or vinyl. It has on one side thereof the joining protuberances 72*a* and on the other side thereof the auxiliary protuberances 72*b* and engaging grooves 72*c*, and this wall material is spread between the inner peripheral surfaces of the rings 1 instead of the wall plates 6*a*. Use of such wall material 6*f* can dispense with the refractory wall material 6*b*, waterproof wall material 6*c* and rubber sheet 14 to reduce the external finishing work. Further, since many pieces of such wall material are joined successively widthwise by engaging the protuberances 72*a* in the corresponding grooves 72*c*, use of such wall material provides excellent draining effect and waterproofness as well as high mechanical strength. If plate blocks 6*a'* are fitted in the recesses 72*d* formed inside of the wall material 6*f* when it is applied, even greater reinforcing effect is obtained. Also, since the heat-insulating wall material 6*d* and decorative board 6*e'* can be easily nailed to the inside of wall material 6*f*, the interior work can be simplified. In the foregoing embodiment, round windows 24, 24 and 33, 33 are provided in the front and rear end walls 15 and 16, respectively, but these windows may be of any other suitable shape and size that are desirably selected by taking into consideration the ventilation and lighting condition. A window or windows 4 may be also provided in the peripheral wall 6** to improve ventilation and lighting.

The interior fixtures of the structure A are not restricted to those described above. For example, a study or an office may be formed by placing a desk or desks, etc., in the inside of the structure. Also, the interior space may be widened to make a hall. The room arrangement may be also suitably planned. Further, the structure A may be bisected crosswise by a central partition wall into two perfectly separate compartments, with porchways being provided at both ends of the structure, so as to form a so-called semidetached house. It is also possible to make the structure into a warehouse by providing a plurality of shelves in its inside.

Now, the installation of the above-described unit structure A will be discussed.

Figure 12:
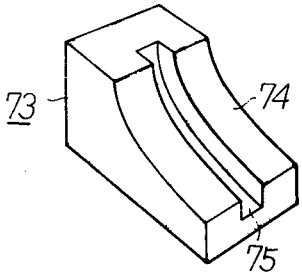
FIG. 12 is an enlarged perspective view of a base or chock used for installation.
Figure 13:
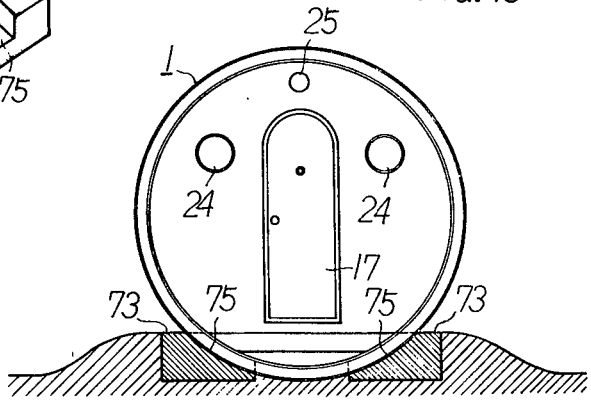
FIG. 13 is a front view of a structure locked in place by using the chocks.

Referring to FIGS. 12 and 13, there is illustrated a first method of installation using holdfasts or chocks 73. Each of the chocks 73 may be made from a concrete block having a desired width. The upper side of the block is partly curved to form an arc-shaped supporting face 74 having a curvature corresponding to that of the peripheral wall of the structure, and centrally of supporting face 74 there is formed an arc-shaped groove 75 designed to fit therein a ring 1. These holdfasts 73 are embedded in the ground surface, with the bottom portions of the respective rings 1 of the structure biting into said holdfasts, and then the rings 1 are securely fitted into the grooves 75 in the respective chocks 73 so that the arc-shaped supporting face 74 fits tightly against the peripheral wall 6, thereby setting the structure A in place. In this case, if need be, reinforcing ropes or cables (not shown) may be stretched aslant from both sides of each ring 1 or the peripheral wall to the ground surface to ensure fast fixing.

Figure 14:
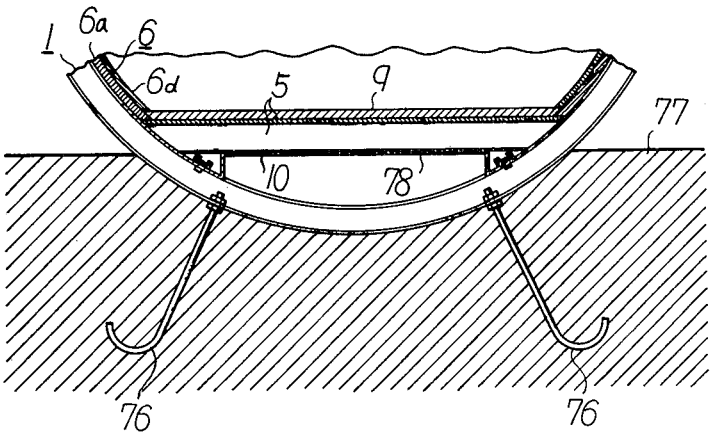
FIG. 14 is an enlarged sectional view of an essential part of the structure locked in place by using anchor bolts.

FIG. 14 illustrates a second method of installation of the structure. According to this method, a suitable number of anchor bolts 76 are joined to suitable parts of the lower portion of each ring 1 and the lower portions of the rings are embedded into the ground together with these anchor bolts 76, followed by pouring concrete 77 for fixing the structure. In this case, the ground-engaging side 10 of the bottom plate 5, its corrugated opening portion, reinforcing bars 2', bottom plate supporting frames 4, and the lower part of the peripheral wall 6 are completely covered with a waterproof sheet 78 such as rubber to prevent corrosion or damage on the underside surface of the structure. In this way, the unit structure A is set up in a leisure land, such as the seaside, the base of a mountain, or other desired site by the method of FIG. 13 or FIG. 14 or other suitable methods, thus obtaining a very unique housing structure (a lodge in the shown embodiment). If need be, suitable pent roofs 79, 80 or the like may be provided on both the entrance and veranda sides of the structure to provide an awning.

In the foregoing embodiment, the structure A has been described for use as a single unit, but a plural number of such structures A may be placed in layers like a pyramid. This mode of use of the structures can reduce the installing area to allow more effective utilization of the space. One of such embodiments is described hereinbelow with reference to FIGS. 15 and 16.

In this embodiment, two structures A1 and A2 are set side by side and another structure A3 is placed thereabove in contact with both lower structures A1 and A2. The structures A1 and A2 of the lower stage are installed adjoining sidewise to each other in the same way as when using the structure singly as said above. In this case, the corresponding rings 1 of both structures A1 and A2 are contacted to each other and coupled at the juncture X by coupling means 81 such as bolts and nuts. Therefore, when using the structures in layers, suitable coupling holes 82 are formed beforehand in the pertinent parts of the outboards **1*b* of the respective rings 1 for facilitating coupling through such holes 82. In the shown embodiment, three coupling means 81 are used for providing secure coupling at each juncture X. Numeral 83 refers to wedge-like washers. Coupling holes 82 are preferably provided in the form of elongated slots at six equidistantly and circumferentially spaced positions, whereby any of the structures A1, A2, A3 can be used for either the lower or upper stage, and many more similar structures can be joined sidewise or vertically at need in the future. Thus, first the structures A1 and A2 for the lower stage are fixed in place in a sidewise joined situation, and then a structure A3 for the upper stage is placed thereabove such that the center of the structure A3 is positioned just above the junction of the lower structures A1 and A2. Since all of the structures A1, A2, A3 are cylindrical in general configuration, there is formed a recess 84 above the joined section of the lower structures A1 and A2, so that the upper structure A3 is placed and held stably in such recess 84, and then the contacted parts of the respective rings 1 of upper structure A3 and lower structures A1, A2 are securely joined together by suitable coupling means 81 such as above-mentioned, thereby securely joining and fixing both the upper and lower structures A1, A2 and A3. Thus, a desired combination of layered structures can be built up by arranging a plurality of unit structures A sidewise as well as vertically in layers and joining them at the contact portions of their respective rings 1**.

Figure 15:
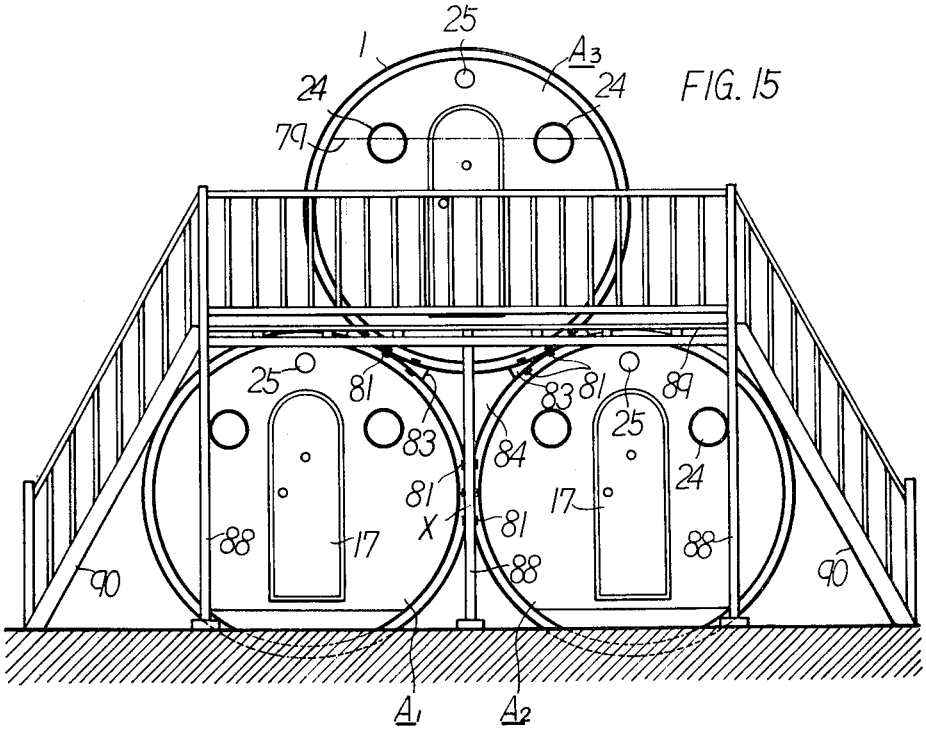
FIG. 15 is a front view illustrating a basic embodiment of the present invention where the unit structures are used in a stacked combination
Figure 16:
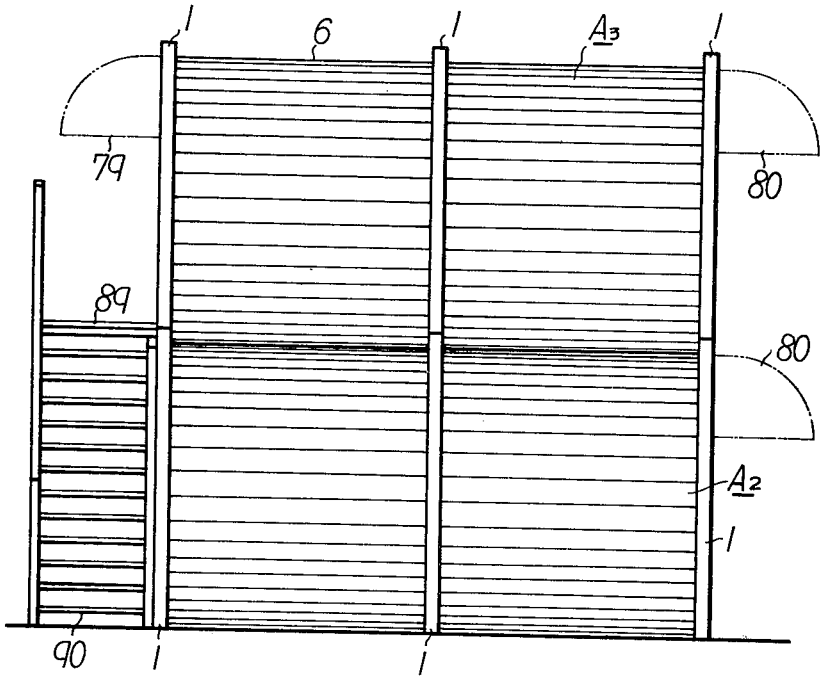
FIG. 16 is a side view thereof.

When making such combination of layered structures, an upstairs corridor 89 is built up with the aid of support pillars 88 for the upstairs structure A3 as shown in FIGS. 15 and 16, and a respective stairway 90 is provided at each end of such corridor. In this case, since the corridor 89 can serves as eaves for the downstairs structures A1 and A2, there is no need of providing any awning for such downstair structures, but a canopy-like awning is provided over the entrance of the upstairs structure A3, or otherwise a roof (not shown) covering the entire length of corridor 89 and stairways 90 may be provided. If desired, an awning 80 may be provided on the veranda side of each of the structures A1, A2, A3.

Figure 19:
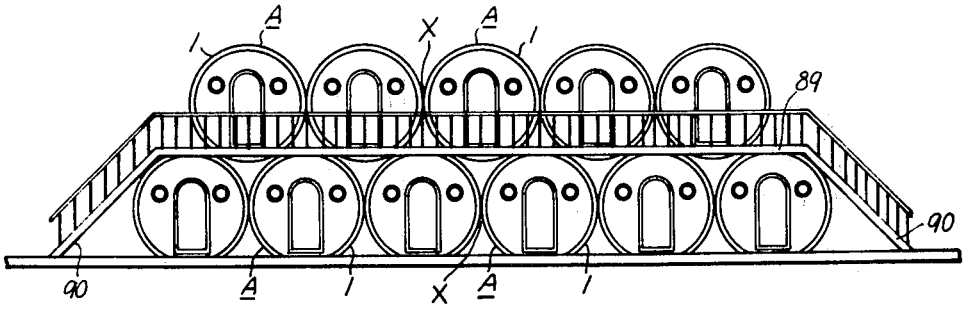
FIG. 19 is a front view showing another example of the stacked assembly of the unit structures.

There has been described hereabove a basic embodiment of the layered combination of structures where three unit structures A1, A2 and A3 were joined and built up to form a double-decker, but the present invention is not limited to such embodiment and the joining means and the number of layers can be determined at will as occasion demands. For example, a plurality of structures A may be arranged side by side for both the lower stage (first floor) and the upper stage (second floor) as shown in FIG. 19. It is also possible to build up such lines of structures in three, four or more layers. Further, such assemblies of layered structures may be built up on both sides of the corridor. In any case, adjacent sidewise or vertically adjoining structures A are coupled together at the contacted portions of the externally projecting rings 1 to thereby assemble the structures, so that a space twice as large as the height of the ring 1 is formed between the peripheral walls 6 of the adjoining structures A. Such space can facilitate the ring joining work and also proves useful for piping arrangement and for drainage of rain water.

Figure 17:
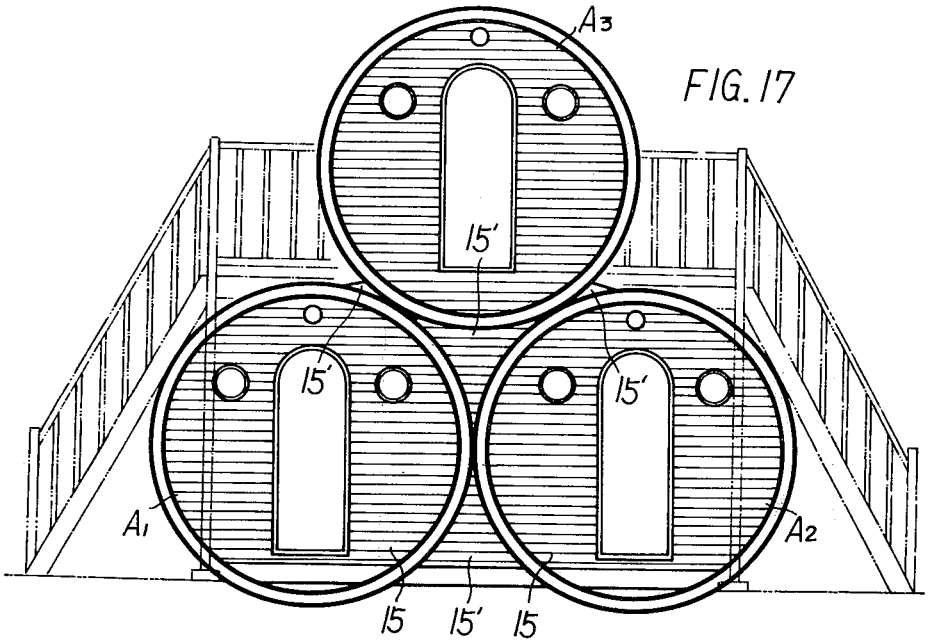
FIG. 17 is a front view of a communicated assembly of the structures.
Figure 18:
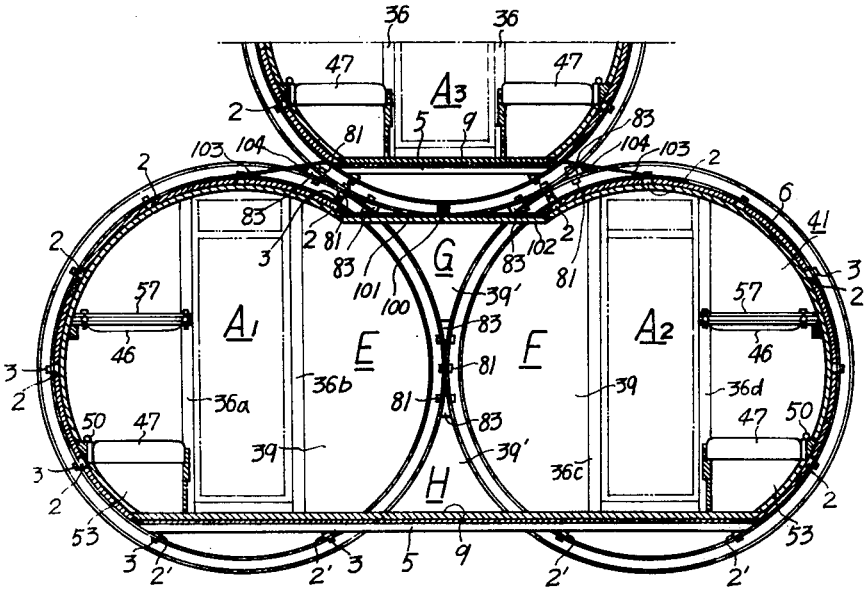
FIG. 18 is an enlarged sectional view of a principal part of the assembly of FIG. 17.

The unit structures according to the present invention can be more efficiently utilized by the embodiment shown in FIGS. 17 and 18. This embodiment may be called a communication type in which the utilization area of the unit structures is enlarged as required.

According to this embodiment, the opposed portions of the peripheral walls 6 of the adjoining unit structures A1 and A2 are cut out while removing certain reinforcing bars supporting the peripheral walls. In the case of FIG. 18, three reinforcing bars are removed. When the structures are communicated, the floor is constructed by first laying a deck plate 5 extending over the bottom reinforcing bars 2' of both unit structures A1 and A2 and then laying thereon a continuous bottom plate 9. As for the ceiling, crossbeams 100 are passed between the respective rings of the unit structure A3 that engage in the corresponding recesses 84, and ceiling boards 101 are fastened to said crossbeams 100 by nailing or other suitable means. Both edges of the ceiling boards 101 are secured, as by nailing, to the notched edge portions of the peripheral walls 6 of both unit structures A1 and A2. Alternatively, crossbeams may be passed axially of the unit structures between the tops of the respective pillars **36*a* to 36*d*, with ceiling 101 being then boarded. This method can be used for forming a one-story assembly of communicated structures. The ceiling 101 is lined with a heat insulating material 102 as in the case of the peripheral wall 6. The upper side of each communicated section is covered with a shelter plate 103 to prevent intrusion of rain water into the ceiling. Such shelter plate 103 is secured to the peripheral wall 6 and an auxiliary frame 104 mounted between the adjoining rings. It is preferable to join the shelter plate 103 to the external decorative metal sheet 6*b* of the peripheral wall 6. The front openings E and F of the communicated unit structures A1 and A2 are closed by a partition wall 39 while the intermediate portions G and H are also closed by a partition wall 39'. It is also possible to provide between the pillars 36*b* and 36*c* a partition wall which extends from the portion E to the portion H so as to perfectly cover the ring portions that are exposed to the inside of the structures. The openings closed by the partition walls 39, 39' are further covered with walls 15, 15' provided to overlie said respective partition walls 39, 39'. The rear side openings are also closed in the same way. The cover walls 15, 15' may be of the same construction as the aforesaid front end wall 15. The closing means for the front and rear openings of the unit structures A1, A2 are, however, not limited to such partition walls 39, 39' and cover walls 15, 15'**; it is possible to use a light-transmitting plate material such as glass, particularly tempered glass. Use of such glass material is preferred from the aspect of lighting.

Described in the foregoing were the communicated type unit structures in duplex combination, but such unit structures can of course be joined and communicated in triplex or more combinations. Thus, such communication can be effected for any number of unit structures either when they are stacked up in layers or when they are used as a bungalow.

According to the present invention, as described above, several rings are joined by horizontal reinforcing bars to form a framework and suitable wall materials are provided on the interior of this framework to constitute a cylindrical unit structure, and then floor materials and door(s) are suitably furnished, so that there can be obtained a very unique structure with a fancy design. Further, since the unit structure is cylindrical, there is no need of differentiating the roof and side wall portions as in the conventional structures of this type, and instead, both roof and side wall portions can be formed integrally with a single peripheral wall. This allows unification of the exterior fittings and reduction of the number of parts necessitated for construction of the structure. Also, when assembling the structure, it is possible to build the peripheral wall by rotating the entire shell, this resulting in markedly improved workability and cost reduction. Moreover, the structure according to the present invention is appreciably greater in strength than the conventional angular or ordinary house-shaped structures. The foundation work can be also simplified by reducing the ground-contacting area.

In case the unit structures are used in layers to form a two- or more decked assembly of structures, they can be easily positioned with extremely good stability as the upper-layer structure(s) is placed stably over the joined section of the adjoining lower-layer structures. Thus, the individual structures can be built up in layers with extremely high efficiency and also the space created between the adjoining layers can be minimized and utilized most effectively. Further, since the adjoining structures are not perfectly attached to each other but are coupled at the contacted portions of their respective rings, a suitable space is formed between the peripheral walls of the respective structures, so that the joining work can be accomplished with ease and also such space provides excellent drainage of rain water and also permits easy installation of the water supply and discharge system and other facilities without necessitating any remodeling or conversion of the unit structure itself.

Still further, by communicating the unit structures with each other, effective utilization of the structures of the present invention is expanded and a desired floor area is obtained. Particularly, the floor space provided by such communication is far larger than the area provided by a single unit, so that the scope of utilization of the present invention is markedly widened.

While the present invention has been shown and described by way of some preferred embodiments thereof, the invention is not limited to such embodiments but can be embodied in various other forms without departing from the scope and spirit of the invention. Thus, the present invention is not restricted by its embodiments other than defined by the following claims.

What is claimed is:

1. A unit housing structure, for stationary on-site installation, comprising, in combination, plural circular rings arranged in axially spaced coaxial relation along a substantially horizontal axis; a plurality of elongated reinforcing bars extending parallel to such substantially horizontal axis and joined to the inner peripheral surfaces of all said rings at circumferentially spaced points therealong to form, with said rings, a horizontally oriented, axially elongated cylindrical framework; a horizontal floor extending chordally of said framework and supported on a pair of longitudinally extending angularly spaced reinforcing bars secured to the inner peripheries of said rings adjacent the lower portion of said framework, said floor extending throughout the length of said framework; a cylindrical side and roof wall on only the interior of said framework, said side and roof wall extending throughout the cylindrical inner periphery of said framework except for the portion thereof beneath said floor, to form a substantially cylindrical laterally enclosed body having said rings projecting radially outwardly from its outer surface; respective end walls closing the axially opposite ends of said body; at least one end wall having a door opening therein closed by an openable door; and interior fittings within said framework enclosed by said walls; said radially outwardly projecting rings protecting said side and roof wall from impacts during transportation and erection of said unit housing structure, and supporting said unit housing structure, with its axis oriented horizontally, on the ground with said side and roof wall and said floor spaced from the ground, and supporting said unit housing structure, with its axis oriented horizontally, on the radially outwardly projecting rings of adjacent said horizontally oriented unit housing structures with said side and roof wall spaced from the side and roof walls of said adjacent unit housing structures.

2. The unit structure as set forth in claim 16, wherein at least one window is provided in the side roof wall above said floor.

3. The unit structure as set forth in claim 16, wherein at least one window is provided in each end wall.

4. The unit structure as set forth in claim 16, wherein said walls are made of a light-transmitting material.

5. A unit building structure comprising, in combination, plural circular rings arranged in axially spaced coaxial relation along a substantially horizontal axis; a plurality of elongated reinforcing bars extending parallel to such substantially horizontal axis and joined to the inner peripheral surfaces of all said rings at circumferentially spaced points therealong to form, with said rings, a horizontally oriented, axially elongated cylindrical framework; a horizontal floor extending chordally of said framework and supported on a pair of angularly spaced reinforcing bars adjacent the lower portion of said framework, said floor extending throughout the length of said framework; a cylindrical side wall on the interior of said framework, said side wall extending throughout the cylindrical periphery of said framework except for the portion thereof beneath said floor, to form a substantially cylindrical laterally enclosed body having said rings projecting radially outwardly from its outer surface; respective end walls closing the axially opposite ends of said body; at least one end wall having a door opening therein closed by an openable door; and interior fittings within said framework enclosed by said walls; in combination with at least one further said unit building structure, arranged in juxtaposition to said first-mentioned unit building structure, with their radially outwardly projecting rings in contact with each other; and fastening means securing said contacting rings to each other; whereby the cylindrical side walls of the juxtaposed unit building structures define usable laterally enclosed spaced therebetween.

6. A unit building structure, as claimed in claim 5, including at least three of said unit building structures arranged with their radially outwardly projecting rings in engagement with each other; at least a pair of said unit building structures being arranged on a common substantially horizontal support in side by side relation with each other; with each pair of unit building structures supporting a third unit building structure positioned thereupon in the upwardly facing recess formed therebetween.

7. A unit building structure, as claimed in claim 5, in which the side walls of laterally adjacent unit building structures having their rings in contact with each other and secured to each other, are partly cut away to establish communication between the laterally adjacent unit building structures; said horizontal floor comprising a common floor extending across and between the laterally adjacent unit building structures; and a common ceiling extending between the cutaway side walls of the laterally adjacent unit building structures to span the space therebetween.

* * * * *